US007825942B2

(12) United States Patent
De Greef

(10) Patent No.: US 7,825,942 B2
(45) Date of Patent: Nov. 2, 2010

(54) IMAGE PROCESSING METHOD AND APPARATUS ADJUSTING IMAGE DATA IN ACCORDANCE WITH IMAGE DATA SUB-PIXELS

(75) Inventor: Petrus Maria De Greef, Eindhoven (NL)

(73) Assignee: NXP B.V., Eindhoven (NL)

( * ) Notice: Subject to any disclaimer, the term of this patent is extended or adjusted under 35 U.S.C. 154(b) by 689 days.

(21) Appl. No.: 11/596,332

(22) PCT Filed: May 4, 2005

(86) PCT No.: PCT/IB2005/051466

§ 371 (c)(1),
(2), (4) Date: Nov. 10, 2006

(87) PCT Pub. No.: WO2005/109391

PCT Pub. Date: Nov. 17, 2005

(65) Prior Publication Data

US 2008/0094346 A1 Apr. 24, 2008

(30) Foreign Application Priority Data

May 11, 2004 (EP) ..... 04102038

(51) Int. Cl.
*G09G 5/02* (2006.01)

(52) U.S. Cl. ..... 345/690; 345/102

(58) Field of Classification Search ..... 345/30–104, 345/690–693
See application file for complete search history.

(56) References Cited

U.S. PATENT DOCUMENTS 5,262,863 A * 11/1993 Okada ..... 348/679
6,292,171 B1 * 9/2001 Fu et al. ..... 345/156
6,373,533 B1 4/2002 Kawabata et al.
6,463,173 B1 * 10/2002 Tretter ..... 382/168
6,600,514 B1 * 7/2003 Van Asma et al. ..... 348/458
6,750,906 B1 * 6/2004 Itani et al. ..... 348/229.1
6,762,800 B1 * 7/2004 Nie et al. ..... 348/687
2002/0130830 A1 9/2002 Park
2002/0196264 A1 * 12/2002 Goetz ..... 345/611

(Continued)

FOREIGN PATENT DOCUMENTS

WO WO 0013405 3/2000

OTHER PUBLICATIONS

English translation of Japanese patent application JP 11-109317 by Kenji Watanabe.*

(Continued)

*Primary Examiner*—Chanh Nguyen
*Assistant Examiner*—Adakou Foli

(57) ABSTRACT

A method for processing a frame of image data, wherein the image data is amplified by a gain factor determined in dependence of a number of sub-pixels within said frame of image data having a luminance above a first threshold value. The resulting gain factor allows for optimal amplification of the image data without loss of local detail. This leads to a better perceived image quality. In a preferred embodiment, the gain factor is simultaneously used for reducing the backlight intensity in a backlit LCD device. Thereby, the perceived image quality is similar to that of the unprocessed image data, however the power consumption of the LCD backlight is reduced substantially.

20 Claims, 3 Drawing Sheets

U.S. PATENT DOCUMENTS

| | | | | |
|---|---|---|---|---|
| 2003/0184659 | A1* | 10/2003 | Skow | 348/223.1 |
| 2004/0234165 | A1* | 11/2004 | Lee | 382/300 |
| 2005/0001801 | A1 | 1/2005 | Kim | |
| 2005/0057666 | A1* | 3/2005 | Hu et al. | 348/229.1 |

OTHER PUBLICATIONS

Hwang et al, Late-News Paper: Image Synchronized Brightness Control:, 29.4L, 2001, SID 01 Digest, pp. 492-493.

* cited by examiner

IMAGE PROCESSING METHOD AND APPARATUS ADJUSTING IMAGE DATA IN ACCORDANCE WITH IMAGE DATA SUB-PIXELS

BACKGROUND OF THE INVENTION

The invention relates to a method for processing image data to be displayed on a display device, for example an LCD panel for mobile applications.

The invention further relates to a display driver incorporating circuitry for processing color image data according to such a method.

It is well known in the art to drive a display device with image data, which is generated for example by a video processor and supplied to the display device for displaying an image thereon. The image data are supplied in frames which are subsequently shown on the display. Each frame constitutes a complete image.

The frames of the image data may be processed in order to appeal as much as possible to a viewer watching the image. For example, increasing the brightness of the image data for this purpose has been known since the earliest television systems, where adapting the brightness of the image data is usually implemented as a manual control.

While increasing the brightness does contribute to obtaining a more pleasing image, the effect of it is limited as a too large brightness increase may lead to loss of local detail. That is, details in areas of the image having an initial brightness value that is already high are lost, as increasing the brightness results in all pixels within such areas clipping to the maximum luminance value of the display.

BRIEF SUMMARY OF THE INVENTION

It is an object of the invention to process the image data in such a way, that an optimal contrast gain is ensured without loss of local detail.

This object has been achieved by means of a method for processing image data according to the invention as specified in independent claim 1. Further advantageous embodiments are specified in the dependent claims.

In the method according to the invention, a frame of image data is received, and an optimal gain factor for this particular frame is determined by establishing how many sub-pixels within the frame have a luminance above a first threshold value. This is a measure for how many sub-pixels will clip when the luminance is increased. Therefore, when this value is used to determine the gain factor used for amplifying the image data, the luminance of the frame is increased in an optimal way, maintaining local detail as much as possible. The amplified image data is supplied to the display device.

The method according to the invention may use any one or any combination of sub-pixels to determine the gain factor. For example, the gain factor can be derived from the brightness of all three sub-pixels in a conventional color display, that is from the brightness of the primary colors red, green and blue taken together, or alternatively from the brightness of sub-pixels corresponding to the primary color green only.

Instead of increasing the perceived image contrast, the method according to the invention can also be used to save power in a backlit LCD device. In this case, the gain factor with which the image data luminance is amplified is also used for reducing the luminance of the backlight system of such an LCD device.

As a result, the appearance of the amplified image data on the LCD device with reduced backlight intensity is very similar to the appearance of the original image data on the LCD device with full backlight intensity. This is particularly advantageous in a mobile device where the LCD backlight is a major contributor to the total power consumption. By virtue of the method according to the invention, the backlight intensity can be reduced while maintaining essentially the same image quality. Thereby, a decrease in power consumption is obtained, resulting in a noticeable increase in battery life of the mobile device.

In a first embodiment of the method, the optimal gain factor is determined by generating a sub-pixel histogram for the frame of the image data. The gain factor is determined in accordance with the ratio between the number of sub-pixels in the highest bins, that is the bins corresponding to a brightness value above the first threshold value, and the total number of sub-pixels. In this first embodiment, the first threshold value is for example chosen at 70%, 75% or 80% of the maximum luminance value.

If there are hardly any bright pixels in the frame of image data, the highest bins are relatively empty and as a result the gain factor can be relatively high, as the brightness can be increased substantially without the risk of clipping pixels and loss of local detail. Preferably, the gain factor is limited to a maximum value, for example 1.3, 1.4 or 1.5.

On the other hand, if the whole image is relatively bright, i.e. there are many bright pixels in the frame, the ratio between the number of pixels in the highest bins and the total number of pixels is large. Increasing the luminance is then hardly possible without loss of local detail, and the gain factor should be equal or close to unity.

Preferably in the first embodiment, the histogram bins are weighted in accordance with their corresponding luminance values. That is, the number of sub-pixels in a bin just above the first threshold value is given less weight for determining the gain factor as the number of sub-pixels in a bin just below the maximum luminance value.

In a second embodiment, the gain factor is adjusted stepwise. The image data is firstly amplified using the current gain factor, and subsequently, if the gain factor turns out to be too high or too low, it may be adjusted. Thus, the gain factor may be adjusted in accordance with the result of a comparison between the luminance of the sub-pixels of the amplified image data with the first threshold value. In this second embodiment, the first threshold value is generally equal to a maximum luminance value.

If the frame of amplified image data has many sub-pixels with a luminance level above the first threshold value, i.e. sub-pixels that will clip to the maximum luminance level, the gain factor is reduced, and the image data is now amplified by the reduced gain factor. A comparison is again made between the luminance of the sub-pixels of the amplified image and the first threshold value, and these steps are repeated until an optimal gain factor for this particular frame of image data is reached.

Similarly, if the amplified image data has no or few sub-pixels with a luminance level above the first threshold value, there is room for further amplification of the image data, and thus the gain factor is increased. The image data is now amplified by the increased gain factor, and this is repeated until an optimal gain factor for this particular frame of image data is reached.

In the second embodiment, the optimal gain factor is determined in an iterative process. The stepwise adjustment of the gain factor may be carried out using a fixed step size, but preferably, the step size is variable. This can be embodied in an easy way by counting the number of sub-pixels in the amplified image data that have a luminance above the first threshold value, and using the counted value to look up the step size for the gain factor adjustment in a look-up table. In this way, the iterative process of the second embodiment reaches the optimal gain factor faster, so that the stepwise adjustment of the image amplification and/or backlight intensity reduction is hardly noticeable.

In a further preferred embodiment, the luminance of the sub-pixels within the received frame of image data is further compared with a second threshold value. In particular, the number of sub-pixels is counted that have a luminance lower than second threshold value. The counted number is then used to determined an offset value to be subtracted from the sub-pixels within the received frame. That is, the luminance of each pixel is reduced by the offset value.

This is advantageous when a particular frame of image data is received that has a limited number of dark pixels, in particular little detail in dark areas. In this embodiment, the number of dark sub-pixels is counted and if their number is relatively small, the luminance of each pixel of the frame is reduced by an offset value. This is advantageous, as it allows the gain factor used for amplifying the image data to be increased further.

In the first embodiment, the number of dark sub-pixels can be obtained directly from the histogram, in particular from the histogram bin corresponding to the lowest luminance value. Alternatively, in the second embodiment, the luminance of the sub-pixels of the amplified image data can be simultaneously compared to both the first and second threshold values.

Preferably, loss of local detail is further reduced by detecting critical areas in the frame of image data, where many adjacent bright pixels are clipped. Thus, in areas with bright pixels, where local detail is relatively low, the gain factor should be reduced locally without introducing any other artifacts.

A two-dimensional spatial filter is suitable for this, however a one-dimensional (1D) spatial filter can be implemented more efficiently and has been found to have sufficient performance for this purpose. Preferably, the filter is an 8-tap 1D spatial filter, which is more preferably only operated on sub-pixels having a luminance larger than a third threshold value, such as 50%. In the first embodiment, the third threshold value may alternatively be equal to the first threshold value.

The method according to the invention can be implemented in hardware; preferably a display driver such as an LCD panel driver, for example the Philips PCF8833 or PCF8881, or an image processing chip, such as the Philips PNX4000 Nexperia mobile image processor, can be provided with dedicated circuitry for carrying out the method.

Alternatively, the image processing can be carried out by a computer program, preferably the firmware of a mobile device such as a mobile phone, a PDA or a digital camera.

BRIEF DESCRIPTION OF THE DRAWINGS

The method will now be described and elucidated further with reference to the accompanying drawings. Herein.

DETAILED DESCRIPTION OF THE INVENTION

Figure 1:
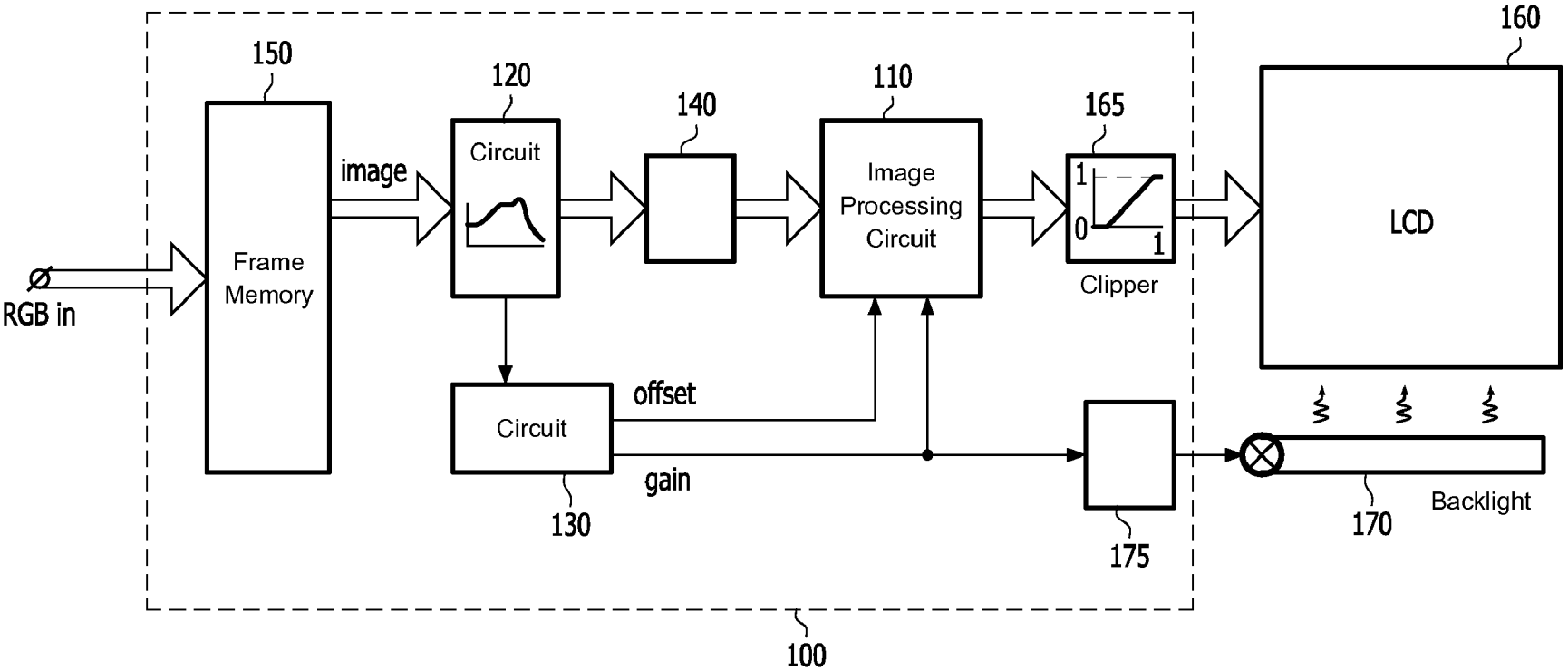
FIG. 1 is an LCD device incorporating the first embodiment of the method according to the invention.

FIG. 1 shows a display device, in particular a backlit LCD device, where the first embodiment of the method according to the invention is incorporated in dedicated circuitry in the display driver 100 for the LCD panel 160. The LCD driver is preferably of a type as normally seen for mobile applications, therefore it has an embedded frame memory 150 for storing parts of the image data. Instead of having to write each frame of image data to the display driver in its entirety, such an LCD device saves power by storing parts of the frame that are not changed in the embedded frame memory 150. This is especially beneficiary when static images are being displayed.

The method according to the invention is preferably carried out between the frame memory 150 and the column drivers (not shown) feeding the image data to the columns of pixels of the LCD panel 160.

In the first embodiment, the image data is firstly fed to a circuit 120 for generating a sub-pixel histogram for the frame of image data stored in the frame memory 150. The histogram has a number of bins each corresponding to a range of sub-pixel luminance values.

For example, a histogram with 20 bins is used, so that each bin corresponds to a 5% range in pixel luminance values. When generating the histogram, sub-pixels having a luminance between 95% and 100% are counted in the highest bin, sub-pixels having a luminance between 90% and 95% are counted in the second highest bin, and so forth.

However, only the upper bins, which correspond to luminance values above the preset first threshold, are relevant for image processing. The other bins need not be implemented in hardware. If the first threshold is for example 80%, only sub-pixels in the upper 4 bins need to be counted.

The histogram data is output to a circuit 130 for calculating a gain factor to be applied to the image data, and in this case also an offset value to be subtracted from the image data. Calculating the offset value is optional and not necessary for the working of the invention. When a non-zero offset value can be determined, a higher gain factor can be chosen without image artifacts showing up in the image on the display.

The gain factor calculated is preferably also fed to block 175, which calculates a power reduction factor for backlight 170 corresponding to the gain factor. In this case, the backlight intensity is reduced in accordance with the calculated gain factor. This has the advantage that power consumption of the backlit LCD device can be reduced while substantially maintaining the same image quality.

Alternatively, this feature is not activated. Power consumption is then at its original, relatively high level, but image quality is improved by virtue of the method according to the invention. Mixed options, i.e. partial reduction of power consumption and simultaneous partial improvement of perceived image quality, can also be envisaged. Preferably, if the method is controlled by software in the firmware of a mobile device, a menu option can be programmed to choose between these different modes. The user of the mobile device can then choose between image quality and battery life in accordance with this personal preference.

For calculating the gain factor, the histogram bins are preferably weighted in accordance with their corresponding luminance value, so that the brightest sub-pixels have the largest effect on the gain factor calculated. In the above example, with the first threshold at 80%, the pixel count in the highest bin (95%-100%) could be weighted 8 times more than the pixel count in the bin just above the first threshold (80%-85%), the pixel count in the second highest bin (90%-95%) could be weighted 4 times more, and the pixel count in the third highest bin (85%-90%) could be weighted 2 times more.

After the histogram generating circuit 120, the image data passes through a filtering circuit 140 for generating filtered image data from the original image data. The filter is used for detecting critical areas in the frame of image data, where many adjacent bright pixels are clipped. In this case, the filter applied on the original image data is an 8-tap 1D spatial filter with equal weights, which is only operated on sub-pixels having a luminance larger than 50%. Applying this filter results in image data with locally reduced luminance. Again, the filtering step is only a preferred step and not necessary for the working of the invention. When the filtering step is implemented, the gain factor can be calculated more aggressively, without image artifacts showing up in the image on the display.

Both the original image data and the filtered image data are supplied to the image processing circuit 110. This processing circuit carries out three operations on the original image data:

- subtracting the offset value calculated in block 130 from each pixel of the frame of image data
- amplifying the image data by the gain factor calculated in block 130, and
- subtracting the filtered image data from the amplified image data.

After this, the image data is clipped by clipper 165 to prevent out-of-range values, and is supplied to the LCD panel 160. The clipper essentially sets sub-pixels with negative luminance values to 0, and sub-pixels with luminance values larger than 1 are clipped to 1. However, from the above it should be clear that when implementing the method according to the invention the number of sub-pixels that need to be clipped will be small.

Figure 2A:
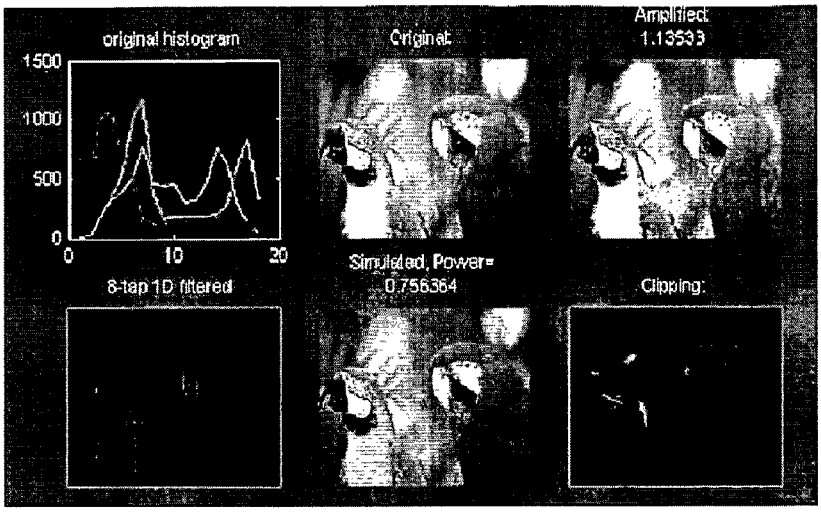
FIGS. 2A-2C show frames of image data as processed by the first embodiment.
Figure 2B:
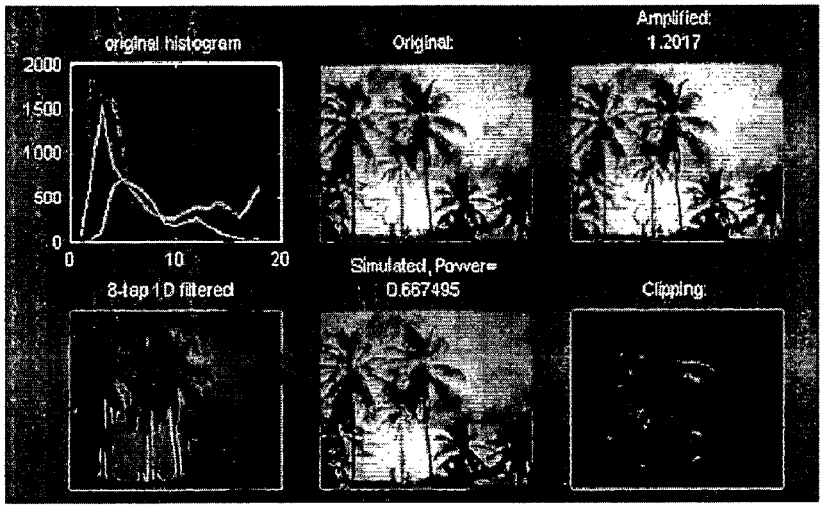
Figure 2C:
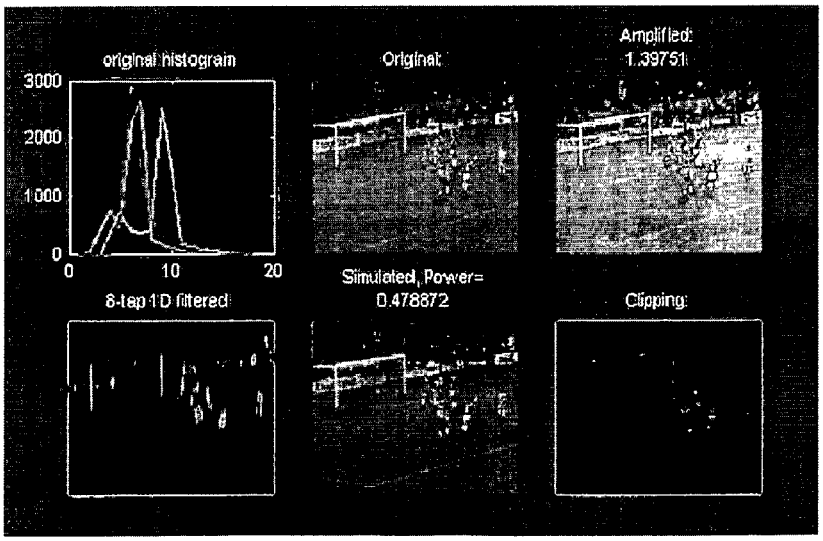

FIGS. 2A, 2B and 2C show three examples of images processed with the first embodiment of the method according to the invention. The image data in these examples is received in RGB format. The original images are displayed in the middle of the top row of images in the figures, the luminance histograms for the red, green and blue sub-pixels of the image are shown in the left image of the top row.

The histograms used here have 18 bins, from which the upper 4 bins corresponding to the highest luminance values are used in calculating the gain factor. The histograms are generated separately for red, green and blue. The gain factor calculated from the histograms is an average for the three colors.

Thus, the numbers of sub-pixels in the upper 4 bins for the red, green and blue colors are weighted and added, and the total number is divided by the total number of sub-pixels in the image for determining the gain factor.

In a particularly efficient embodiment, the image data could alternatively be received in YUV format; in this case the gain factor can be determined from the luminance (Y) data only.

The right image in the top row represents the original image data, amplified by the gain factor calculated from the histograms. The gain factor is indicated over the image.

The left image in the bottom row represents the data obtained by filtering the brightest sub-pixels with an 8-tap 1D spatial filter. The filter data shown here is subtracted from the amplified image shown at the top right, and the resulting image is supplied to the LCD panel. The resulting image is represented by the center image in the bottom row. In particular, this image represents the image data as rendered on a backlit LCD display, of which the backlight intensity is reduced by the power factor indicated above the image. The power factor is directly calculated from the offset and gain factors.

Finally, the right image in the bottom row gives an indication for which sub-pixels of the image clipping still occurs. That is, this image shows which sub-pixels had been processed by the hard clipper 165, before the image data was supplied to the display panel.

FIG. 2A shows a image of parrots as processed by the first embodiment. The luminance distribution of this image is fairly even through the three primary colors, as can be seen in the histograms. The gain factor is about 1.14, which allows for a reduction in backlight intensity of 24%. Some clipping is visible.

FIG. 2B shows an image of a sunset. In this particular image, the luminance distribution is still fairly even throughout each primary color, although the emphasis is somewhat more on dark colors. However the lowest bin of the histograms is relatively empty, therefore an offset value was subtracted from the image data. As a result, the gain factor is slightly higher at 1.20, leading to a reduction in backlight intensity of 37%. The amount of clipping is minimal.

FIG. 2C shows an image from a football match. The histograms for all three primary colors peak around medium luminance levels, therefore the gain factor is very close to the upper limit which is set to 1.40 in this example. It can be seen that the image as rendered on the display is hardly reduced in quality, while the backlight power could be reduced by 52%.

Figure 3:
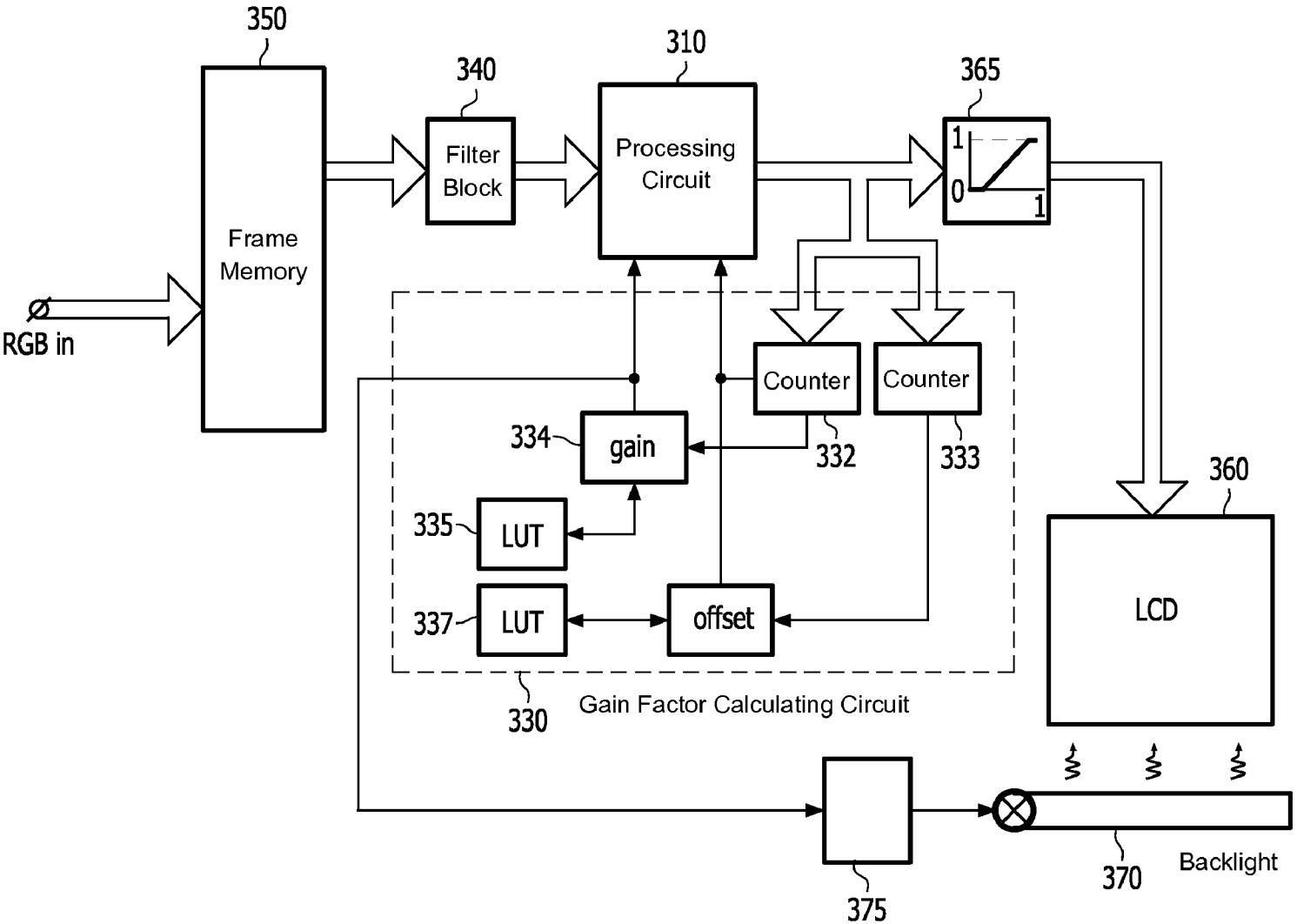
FIG. 3 is an LCD device incorporating the second embodiment of the method according to the invention.

FIG. 3 shows an LCD device incorporating the second embodiment of the method according to the invention in the display driver 300.

In this second embodiment, the image data from the frame memory 350 goes directly to the filter block 340, where filtered image data is generated from the original image data by means of an 8-tap 1D filter as set out in the above.

The processing circuit 310 and gain factor calculating circuit 330 are arranged in a feedback loop in this embodiment. As a result, the optimal gain factor is calculated in an iterative process, whereas in the first embodiment it is directly obtainable from the histogram data.

The processing circuit 310 amplifies the image data with the current gain factor. Then, the amplified image data is processed by a counter 332 which counts the number of sub-pixels having a luminance larger than the first threshold. Usually, the first threshold in this embodiment is the maximum luminance that can be displayed on the LCD panel 360. Also, counter 333 counts the number of sub-pixels having a luminance smaller than the second threshold.

The current gain factor is stored and adapted in block 334. This block retrieves the value counted by counter 332 and compares it to values stored in a look-up table 335. This look-up table contains, for a number of possible counted values, step sizes for correction of the gain factor. The step size corresponding to the current counted value is retrieved and the gain factor is corrected in accordance therewith. Processing circuit 310 now amplifies the image data using the corrected gain factor.

If the counted value is large, many pixels have a luminance larger than a maximum luminance. The resulting step size should be a negative number, so as to decrease the gain factor and reduce the number of out-of-range pixels. On the other hand, if the counted value is small, there is room for further amplification of the image data, thus the resulting step size will be a positive number. If the gain factor is already optimal, the counted value will be such that the step size obtained from the look-up table 335 is small. Obviously, in this case, the gain factor needs no further change for this particular frame of image data. To avoid luminance oscillations, the feedback gain signal is filtered.

The current offset value is stored and adapted in block 336. Similar to the gain factor adjustment circuit, block 336 retrieves the value counted by counter 333 and compares it to values stored in look-up table 337. This look-up table contains, for a number of possible counted values, step sizes for correction of the offset value. The offset value is adapted accordingly, and processing circuit 310 now subtracts the corrected offset value from the image data.

For a particular static frame of image data, the feedback loop of processing circuit 310 and gain factor calculating circuit 330 thus repeatedly adapts the gain factor and offset value, and processes the image data in accordance with the adapted gain factor and offset value. If the gain factor is found to be optimal, the gain factor and offset value will not be adapted further.

The amplified image data output by processing circuit 310 is received by block 365, which in the second embodiment firstly subtracts the filtered image data from the amplified image data, and then performs a hard clipping operation on the image data. The output of block 365 is connected to the LCD panel 360 for displaying the image.

The gain factor from block 334 is, similarly to the first embodiment, preferably also fed to block 375, which calculates a power reduction factor for backlight 370 corresponding to the gain factor. Due to the gradual change of gain factor, the backlight intensity also changes gradually over a couple of frame times upon an image change in the second embodiment. This may be observable by the viewer.

The drawings are schematic and not drawn to scale. While the invention has been described in connection with preferred embodiments, it should be understood that the protective scope of the invention is not limited to the embodiments described herein. Rather, it includes all variations which could be made thereon by a skilled person, within the scope of the appended claims.

In summary, a method for processing a frame of image data, wherein the image data is amplified by a gain factor determined in dependence of a number of sub-pixels within said frame of image data having a luminance above a first threshold value. The resulting gain factor allows for optimal amplification of the image data without loss of local detail. This leads to a better perceived image quality. In a preferred embodiment, the gain factor is simultaneously used for reducing the backlight intensity in a backlit LCD device. Thereby, the perceived image quality is similar to that of the unprocessed image data, however the power consumption of the LCD backlight is reduced substantially.

The invention claimed is:

1. A method for processing image data for a display device, the method comprising:

receiving a frame of the image data, the image data including an array of pixels, each pixel comprising at least one sub-pixel;

generating a luminance histogram having a plurality of bins, wherein said luminance histogram includes a plurality of upper bins, each of said upper bins corresponding to a luminance above a preset first threshold value;

determining a gain factor by counting a number of sub-pixels in the upper bins of the luminance histogram and setting the gain factor in a proportional relation to said counted number; and amplifying the image data by said gain factor to generate an amplified image data.

2. The method of claim 1, wherein the display device is a backlit LCD device, further comprising:

reducing an intensity of a backlight of said backlit LCD device by an amount corresponding to the gain factor.

3. The method of claim 1, wherein said counting is a weighted count in which the upper bins of the luminance histogram are weighted in accordance with their corresponding luminance value.

4. The method of claim 1, further comprising:

filtering the amplified image data with a filter suitable for detecting areas having many adjacent bright pixels to generate a filtered amplified image data; and correcting the amplified image data using the filtered amplified image data.

5. The method of claim 4, wherein the filtering includes applying a multi-tap 1D spatial filter on pixels having a luminance larger than 50%.

6. The method of claim 1, wherein each pixel has at least a first sub-pixel representing a first color and a second sub-pixel representing a second color, wherein said generating a luminance histogram includes generating at least a first sub-pixel luminance histogram and a second sub-pixel luminance histogram based on said first sub-pixels and said second sub-pixels of said frame of image data, respectively, each of said first and second sub-pixel histograms having a plurality of bins wherein each bin corresponds to a range of sub-pixel luminance values, wherein said first sub-pixel luminance histogram includes a plurality of upper bins and wherein said second sub-pixel histogram includes a plurality of upper bins, each of said upper bins corresponding to a luminance above said preset first threshold value, and wherein said determining a gain factor determines the gain factor based on a proportional relation to a count of a number of first sub-pixels in the upper bins of the first sub-pixel luminance histogram and a number of second sub-pixels in the upper bins of the second sub-pixel luminance histogram.

7. The method of claim 6, wherein said determining a gain factor determines the gain factor based on a proportional relation to an average of the number of first sub-pixels in the upper bins of the first sub-pixel luminance histogram and the number of second sub-pixels in the upper bins of the second sub-pixel luminance histogram.

8. The method of claim 7, wherein said average includes weighting, by a bin-specific weight, a number of first sub-pixels in each of the upper bins of the first sub-pixel luminance histogram, and weighting, by a bin-specific weight, a number of second sub-pixels in each of the upper bins of the second sub-pixel luminance histogram, summing said weighted numbers to generate a total number, and dividing said total number by a total number of sub-pixels in the image data.

9. A display driver, comprising:

an input that receives a frame of image data, the image data including an array of pixels, each pixel comprising at least one sub-pixel;

a histogram generator that generates a luminance histogram having a plurality of bins, wherein each bin corresponds to a range of sub-pixel luminance values, and wherein said bins include a plurality of upper bins having a luminance above a preset first threshold value;

a circuit that determines a gain factor by counting a number of sub-pixels in the upper bins of the luminance histogram and setting the gain factor proportional to said counted number; and an image processing circuit that amplifies the image data by said gain factor.

10. The display driver of claim 9, further comprising:

a block that calculates a power reduction factor for a backlight that corresponds to the gain factor.

11. The display driver of claim 9, wherein said circuit performs said counting as a weighted count in which the upper bins are weighted in accordance with their corresponding luminance value.

12. The display driver of claim 9, further comprising:

a filter that detects areas having many adjacent bright pixels and produces filtered image data, wherein the display driver corrects the amplified image data using the filtered image data.

13. The display driver of claim 12, wherein the filter is a multi-tap 1D spatial filter that operates on pixels having a luminance larger than 50%.

14. The display driver of claim 9 wherein said input is an input that receives image data wherein each pixel has at least a first sub-pixel representing a first color and a second sub-pixel representing a second color, wherein said histogram generator is a generator that generates at least a first sub-pixel luminance histogram and a second sub-pixel luminance histogram based on said first sub-pixels and said second sub-pixels of said frame of image data, respectively, each of said first and second sub-pixel histograms having a plurality of bins wherein each bin corresponds to a range of sub-pixel luminance values, wherein said first sub-pixel luminance histogram includes a plurality of upper bins and wherein said second sub-pixel histogram includes a plurality of upper bins, each of said upper bins corresponding to a luminance above said preset first threshold value, wherein said circuit is a circuit that determines the gain factor based on a proportional relation to a count of a number of first sub-pixels in the upper bins of the first sub-pixel luminance histogram and a number of second sub-pixels in the upper bins of the second sub-pixel luminance histogram.

15. The display driver of claim 14, wherein said circuit is a circuit that determines the gain factor based on a proportional relation to an average of the count of a number of first sub-pixels in the upper bins of the first sub-pixel luminance histogram and a number of second sub-pixels in the upper bins of the second sub-pixel luminance histogram.

16. The display driver of claim 15, wherein said average includes weighting, by a bin-specific weight, a number of first sub-pixels in each of the upper bins of the first sub-pixel luminance histogram, and weighting, by a bin-specific weight, a number of second sub-pixels in each of the upper bins of the second sub-pixel luminance histogram, summing said weighted numbers to generate a total number, and dividing said total number by a total number of sub-pixels in the image data.

17. A method for processing image data for a display device, the method comprising:

receiving a frame of the image data, the image data including an array of pixels, each pixel comprising at least one sub-pixel;

providing a gain factor;

amplifying the image data by said gain factor to generate an amplified image data; and counting the number of sub-pixels within said amplified image data having a luminance above a first threshold;

generating a gain factor adjustment step size based on said gain factor and said number of sub-pixels;

updating said gain factor based on said gain factor adjustment step size; and repeating the amplifying, counting, generating and updating steps until an optimal gain factor is reached, wherein the optimal gain factor corresponds to an absolute value of the gain factor adjustment step size having a given sufficiently small magnitude.

18. The method of claim 17, wherein the determining step further comprises:

counting a number of sub-pixels within the amplified image data having a luminance larger than the first threshold value; and obtaining the variable step size from a look-up table based on the gain factor and the counted number.

19. The method of claim 17, further comprising:

counting a number of sub-pixels within said frame of image data having a luminance below a second threshold value;

determining an offset value based on said counted number; and subtracting said offset value from the amplified sub-pixels within the frame of amplified image data to generate an updated amplified image data.

20. The method of claim 17, further comprising:

counting the number of sub-pixels within said amplified image data having a luminance below a second threshold;

generating an offset value based on said number of sub-pixels; and generating an updated amplified image data based on said offset value and said amplified image data, wherein said repeating includes repeating said steps of: amplifying the image data by said gain factor to generate an amplified image data: updating amplified image data based on said offset value and said amplified image data; counting the number of sub-pixels within said amplified image data having a luminance above the first threshold, counting the number of sub-pixels within said amplified image data having a luminance below the second threshold, generating the gain factor adjustment step size, updating said gain factor, and generating an offset value, and repeating said steps until the absolute value of the gain factor adjustment step size has the given sufficiently small magnitude.

* * * * *